United States Patent [19]

Becchi et al.

[11] 3,941,229

[45] Mar. 2, 1976

[54] SERIAL PRINTING DEVICE

[75] Inventors: Raffaele Becchi, Ivrea; Dario Bisone, Montalto Dora, both of Italy

[73] Assignee: Ing. C. Olivetti & C., S.p.A., Ivrea, Italy

[22] Filed: Aug. 5, 1974

[21] Appl. No.: 494,422

[30] Foreign Application Priority Data

Aug. 14, 1973 Italy ..... 69445/73

[52] U.S. Cl. ..... 197/53; 197/18

[51] Int. Cl.[2] ..... B41J 1/32

[58] Field of Search ..... 197/49, 53, 54, 12, 18

[56] References Cited

UNITED STATES PATENTS

| | | | |
|---|---|---|---|
| 723,855 | 3/1903 | Frantz | 197/53 |
| 2,127,251 | 8/1938 | Fischer | 197/12 |
| 2,248,097 | 7/1941 | Larson | 197/53 |
| 3,406,807 | 10/1968 | Sasaki | 197/53 X |
| 3,717,234 | 2/1973 | Koller | 197/53 |

*Primary Examiner*—Harland S. Skogquist
*Attorney, Agent, or Firm*—I. J. Schaefer

[57] ABSTRACT

A serial printing device comprises a type drum rotatably mounted on a carriage which can move parallely to a platen. On the periphery of the type drum are mounted a plurality of character-bearing elements urged against the drum by biasing means. A stepping motor rotates the drum for positioning a selected character-bearing element in front of the platen. A hammer is actuatable for pushing the selected character-bearing element radially outwardly relative to the drum against the action of the biasing means, and the drum is moved towards the platen simultaneously to the actuation of the hammer.

16 Claims, 5 Drawing Figures

SERIAL PRINTING DEVICE

BACKGROUND OF THE INVENTION

1. Field of Invention

The present invention relates to a serial printing device which has a type drum carrying a plurality of character-bearing elements movable radially outwardly thereto and axially rotatable to bring a selected character-bearing element thereon to a printing position and wherein the selected character-bearing element is moved towards a platen to effect printing impact.

2. Description of the Prior Art

It is known to achieve this by leaving the drum bodily unmoved and by striking the selected element with a hammer to project this element radially from the drum, the elements being biased radially inwardly. A disadvantage of this is that the stroke which can be imparted to the element by the hammer is limited and the drum must therefore be near the platen. This obscures the just-printed characters unduly.

It is also known to move the drum bodily towards the platen but it is then necessary to make the selected character-bearing element protrude, otherwise the adjacent characters tend to print partially. To this end, a cam pushes each element out as it moves to the printing point. This has the disadvantage that the elements are constantly pushed out as the drum rotates, leading to excessive wear and fatigue of the resilient means which bias the elements back into the drum.

SUMMARY OF THE INVENTION

The object of the present invention is to provide a printer similar to that described in the preceding paragraph but wherein an element is only protruded from the drum when it is selected for printing.

According to the present invention, there is provided device for in-line typing for typewriters, teleprinters, calculators and similar office machines, comprising a paper-bearing platen, a drum having on its periphery a plurality of character-bearing elements, the drum being rotatable on a support for selection of the elements in front of the platen and in which the character-bearing elements are movable on the drum by the action of a hammer, the support being displaceable relative to a carriage to make the selected character-bearing element strike the roller for typing, wherein a rocker has one extremity connected to the hammer in a manner ensuring a predetermined clearance between the hammer and the character-bearing elements and the other extremity levered on a first member of the carriage, an intermediate part of the rocker having a fulcrum on the support to displace the hammer through a path correspondingly greater that that of the drum during typing, so as to take up the said clearance and make the selected character-bearing element protrude towards the platen beyond the neighbouring character-elements.

The embodiment of the invention to be described below has the additional advantage that individual character-bearing elements of the drum can be interchanged. Furthermore the drum has two rings of characters and the drum is axially shiftable, by shifting the support, to select either of these rings. However the kinematic conditions of the mechanisms involved in printing for moving the support and the hammer are unchanged by the axial shift.

DESCRIPTION OF A PREFERRED EMBODIMENT OF THE INVENTION

Figure 1:
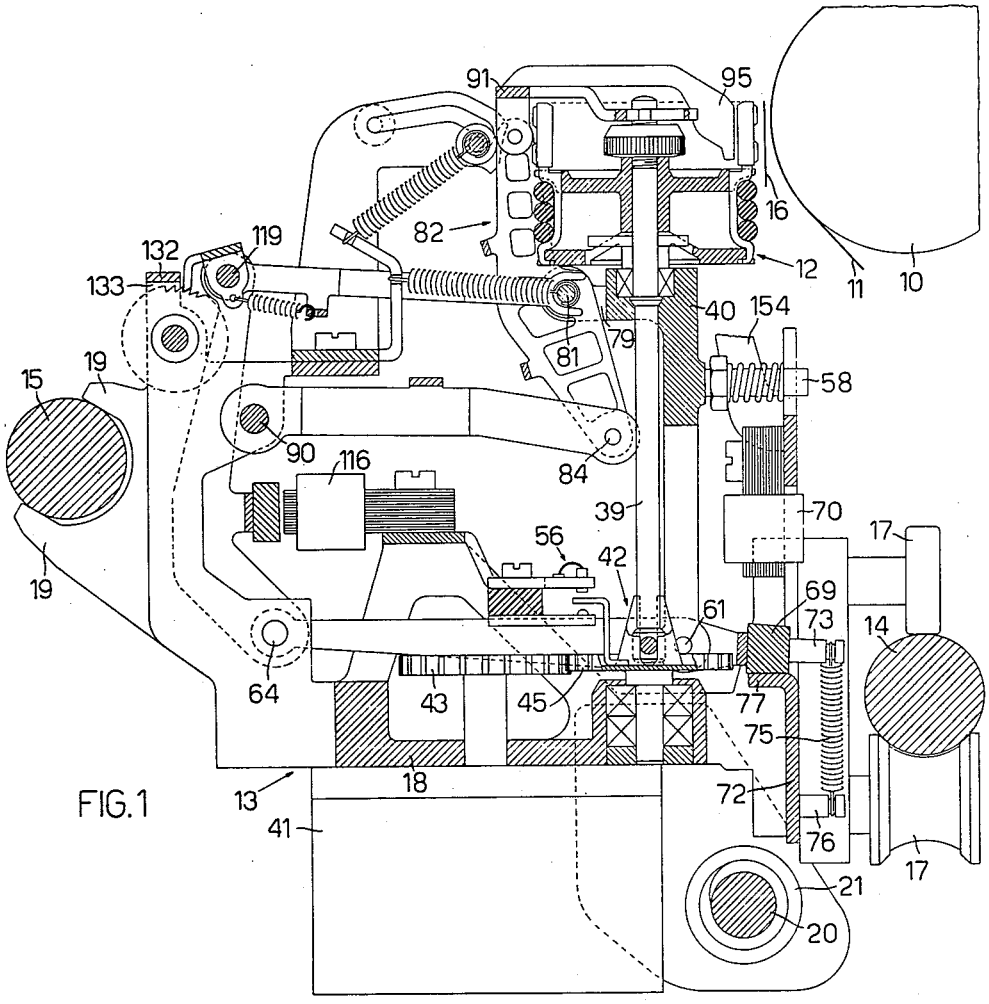
FIG. 1 is a side view, partly in section, of a typing device embodying the invention.
Figure 3:
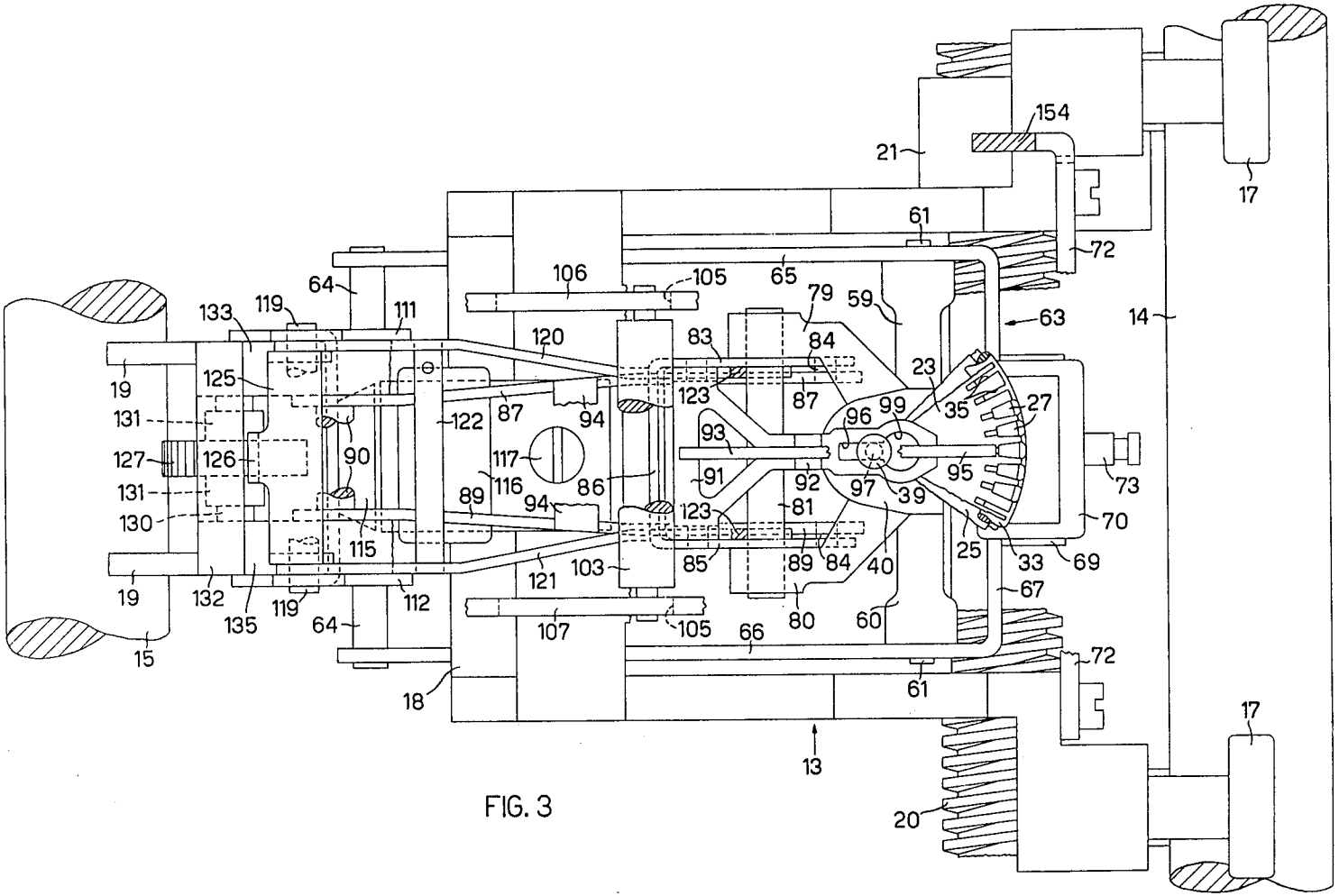
FIG. 3 is a plan view, partly in section, of the typing device.

With reference to FIG. 1 the typing device comprises a paper-carrying platen 10 around which is passed a sheet of paper 11, a typing head 12 mounted on a base member or carriage 13 and an inked ribbon 16 interposed between the typing head 12 and the sheet of paper 11. The carriage 13 comprises two sides 133 and 135 (FIGS. 1 and 3) connected by cross-pieces 18 and 132. The carriage 13 can slide on two guides 14 and 15 parallel to the platen 10 by means of rollers 17 and two jaws 19, and is traversed by a screw 20 which engages with a nut 21 integral with the carriage 13.

The typing head 12 (FIG. 2) comprises a drum with a vertical axis and having a hub 22 provided with two parallel flanges 23 and 25 and with a bore 26 through the hub. On the periphery of the flanges 23 and 25 guided by radial recesses 35, 36 there are systematically arranged small vertically arranged bars 27 bearing the characters 34. Each bar is composed of a lower stem 29 and an upper block 30 on a front face of which are provided in relief two printing characters 34, which lie around two parallel circular tracks.

The stem 29 of each bar 27 is shaped so as to present an outer groove 31 and an under hook 32. Three elastic rings 33 of polyurethane rubber or other similar elastic resilient material are lodged in the grooves 31 of the bars 27 to hold the latter close against the flanges 23 and 25 of the drum 22. Each bar 27 is also hooked by the hook 32 on to a shoulder 37 of the lower flange 25.

The typing head 12 (FIGS. 1 and 2) is mounted on a vertical shaft 39 rotatable on a support 40 to which it is axially fixed. The shaft 39 is connected to a motor for rotary selection 41, for example of the stepwise type, by means of a sliding cardan joint 42 and gears 43 and 45.

The head 12 is positioned with its bore 26 on the top part of the shaft 39 and rests with its lower part on the support 40. A knurled knob 46, screwed onto a terminal threaded part 47 of the shaft 39 holds the head 12 against the support 40. In order to key the head 12 on the shaft 39 in a predetermined angular position, a transverse pin 49 through the shaft and longer on one side than the other is received within a corresponding groove 50 of the drum 22. The typing head can be interchanged by undoing the knob 46.

The sliding cardan joint 42 is composed of two vertical and parallel forks 51 mounted on a hub 52 of the gear 45, and between which there lodges a pin 53 extending through the lower part of the shaft 39.

There is also on the hub 52 a tongue 55 designed to co-operate with a photoelectric sensor 56, mounted on the carriage 13, in order to signal to the electronic control means, not shown in the Figures, the passage of a datum character in front of the typing sheet 11.

The support 40, which carries a ball-bearing 57 in which the shaft 39 is rotatable, extends downwards with two arms 59 and 60 (FIGS. 2, 3) which form a fork and whose ends are connected by pivots 61 to a frame 63 pivoted on pivots 64 of the carriage 13 and composed of two parallel and substantially horizontal levers 65 and 66 interconnected by a crosspiece 67. On the latter there is fixed an armature 69 of an electromagnet 70 which in turn is fixed to a cross piece 72 of the carriage 13.

On the armature 69 (FIGS. 1 and 2) a pin 73 is fixed with a spring 75 hooked to it, the other end of the spring being hooked to a pin 76 on the cross piece 72 designed to hold the armature 69 in contact with a flange 77 of the cross piece 72 when the electromagnet 70 is not energised.

On the back portion of the support 40 there is fixed a horizontal pin 58 having one end lodged in a slot 68 of the cross piece 72. A spring 74 surrounding the pin 58 is compressed between the cross piece 72 and an adjusting nut 78 which can be screwed on a threaded part of the pivot 58.

The support 40 is also provided with two upper side lugs 79 and 80 (FIGS. 1, 2 and 3) connected by means of a pivot rod 81 with the mid portion of a rocker 82 composed of two parallel levers 83 and 85 inter-connected by two cross-pieces 86. The lower ends of the rocker 82 have as fulcra two pivots 84 of a first element of the carriage 13 composed of two support levers 87 and 89 parallel to each other and substantially horizontal, which are inter-connected by a cross piece 94 and are in turn pivoted on a pivot rod 90 of the carriage 13.

At the upper extremity of the rocker 82 there is pivoted a hammer 91 composed of a support plate 92 to which is fixed a stem 93 with a head 95 at one end. The head 95 of the hammer 91 is in line with the character-bearing bar positioned in front of the platen 10 at the printing point, with a clearance of 0.5 to 1 mm relative to the inner portion of the block 30 to allow free rotation of the printing head. The plate 92 has a slot 96 in which there is lodged a neck 97 of the shaft 39. The slot 96 has an enlarged portion 99 which allows the hammer to be swung up clear of the head when the hammer is moved to the left, in FIG. 2, as described below.

A spring 100, stretched between the pivot rod 81 and a bracket 101 of the carriage 13 keeps the rocker 82 normally pulled against a bar 103 whose ends are lodged in two slots 105 of two side-pieces 106 and 107, parallel to each other and fixed to the carriage 13. The back ends of the slots 105 are turned down to form a seat 109 in which the bar 103 is normally held by a spring 110 stretched between the latter and the bracket 101. The bar forms a stop establishing the aforesaid clearance.

On the pivot rod 64 of the carriage 13 are pivoted two actuating levers 111 and 112 which are parallel and substantially vertical and inter-connected by a horizontal cross-piece 113 on which is fixed an armature 115 of an electromagnet 116, fixed to the carriage 13.

The upper ends of the levers 111 and 112 are inter-connected by a pivot 119 rod on which are pivoted the ends of a pair of struts 120 and 121 which are parallel and substantially horizontal. These struts are inter-connected by a cross-piece 122 and each has a fork-shaped end 123 normally engaged on the pivot rod 81 of the support 40. The spring 100 which makes the rocker 82 rest on the bar 103 keeps the armature 115 at a distance from the electromagnet 116 when the latter is de-energised.

There is pivoted on the pivot rod 119 a pawl 126, normally engaged, by the action of a spring 129 stretched between the pawl 126 and the cross-piece 122, with a ratchet wheel 127, mounted on a small shaft 130 of the carriage 13 and held between two friction elements 131. The pawl 126 is also designed to rest against the cross-piece 132 of the carriage 13.

Figure 5:
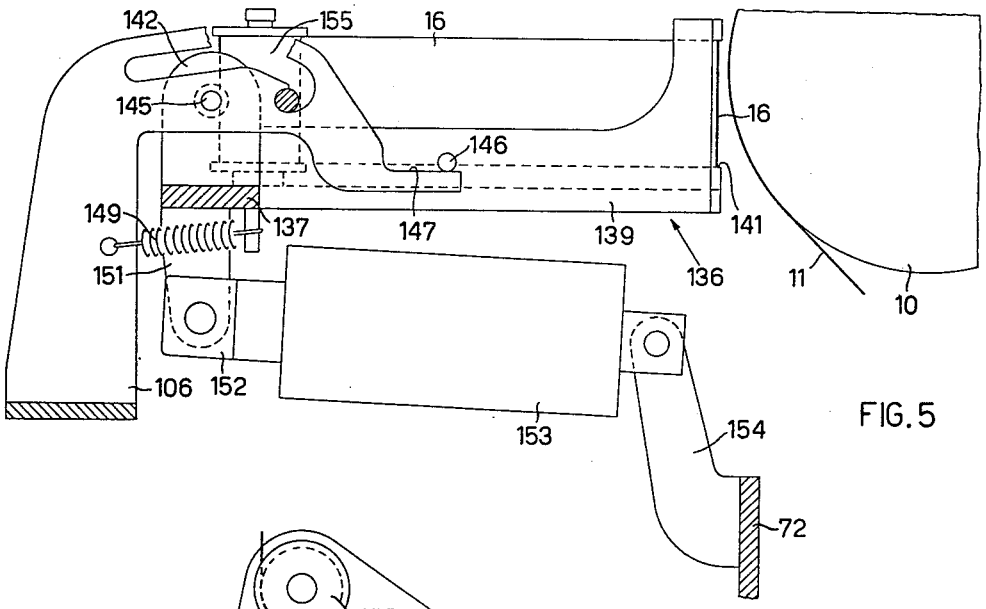
FIG. 5 is a section on the line V—V of FIG. 4.
Figure 4:
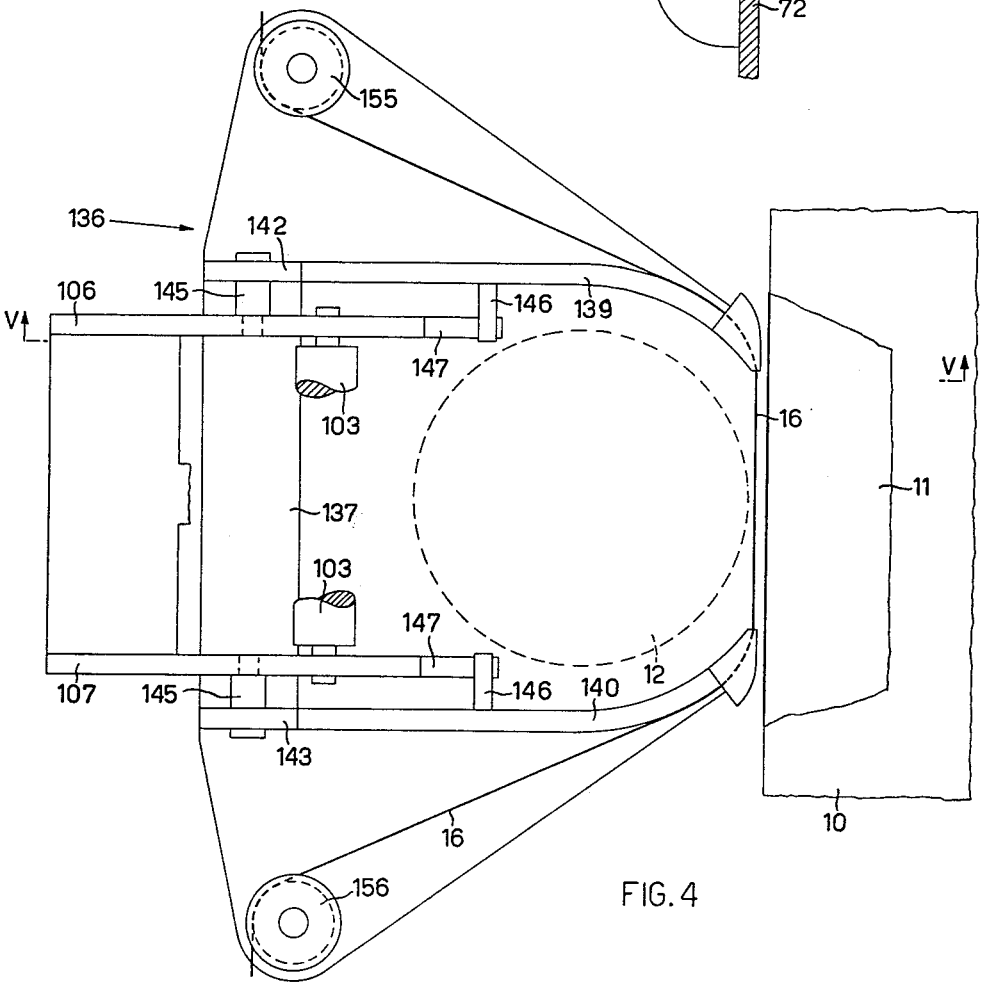
FIG. 4 is a plan view of a detail of the typing device to the invention.

The inked ribbon 16 is supported and guided in front of the characters 34 of the typing head 12 by a support 136 (FIGS. 4 and 5) for example of plastic material and composed of a plate with a horizontal base 137. The ribbon 16 may be, for example, of the kind subdivided into two inked zones, a red lower zone and a black upper zone. This is guided by two rollers 155 and 156 rotatable on the support 136, and is normally lodged between two guides 141 machined at the extremities of two arms 139 and 140 of the plate 137.

The support 136 is provided with two vertical lugs 142 and 143, each of which is pivoted on a pivot 145 of the side-pieces 106 and 107 and is provided with two horizontal pivots 146 each normally held by two shoulders 147 and the side-pieces 106 and 107 by the action of a spring 109 stretched between the side-piece 106 and the support 136. Under these conditions the upper zone of the ribbon is in line with the typing line.

A lower lug 151 of the support 136 is connected to an armature 152 of an electromagnet 153 supported by a bracket 154 of the cross-piece 72. When the electromagnet 153 is energised, it turns the support 136 counter-clockwise round the pivots 145 for selection of the lower zone of the ribbon 16.

In its rest position, the head 12 is distanced from the paper roller 10 and is arranged for printing the characters of the upper track onto the paper sheet 11. Suppose it is desired to print a predetermined character onto the paper sheet 11. When the machine to which the typing device according to the invention is attached is switched on, the step-wise selector motor 41 is made to rotate so as to bring the tongue 55 to the photoelectric sensor 56 which synchronises the electronic control circuits, not shown in the drawings. The character to be printed is selected by sending a series of impulses to the selector motor 41, in a manner known per se. The motor 41, through the mechanical coupling 43 and 45 and the cardan joint 42, will then cause the shaft 39 and hence the head 12 to rotate until it positions the character-carrying bar containing the selected character in front of the roller 10.

If the selected character is on the lower track of the head 12, simultaneously with this rotary selection there is energising of the electromagnet 70 which attracts the armature 69 against the action of the spring 75. The frame 63 also turns counter-clockwise at the pivots 64 and raises the support 40, inducing the change from one character track to the other. The supporting levers 87 and 89 and the struts 120 and 121 are rotated counter-clockwise and then remain substantially parallel to the levers 65 and 66 of the frame 63. In this way the geometry of the system is unchanged, and the ratio of the distance between the pivot 81 and the fulcrum 84 of the rocker 82 and the distance between the same pivot 81 and the pivots 61 of the support 40, does not vary. In addition to this, since the forks 51 are high enough, the shaft 39 remains always engaged with the gear 45.

The electromagnet 153 is energised or not, depending on the required printing colour.

After it has been selected, printing of the character thus positioned is effected by energising the electromagnet 116 which attracts the corresponding armature 115. The actuating levers 111 and 112 thus rotate clockwise on the pivot 64 and bring the struts 120 and 121 to the right (FIG. 2) against the action of the spring 100. The support 40 now rotates clockwise about the pivots 61 so as to bring the typing head 12 to print the selected character on the paper sheet 11. Since the pivots 61 of the support 40 and the pivot 53 of the shaft 39 lie substantially in the same horizontal plane, the shaft 39 and the support 40 remain parallel to each other even during this rotation which does not involve lateral thrusts on the forks 51 due to typing.

Simultaneously with the shifting of the head 12, the struts 120 and 121 cause clockwise rotation of the rocker 82 about the fulcrum 84. Since the distance between the pivot 81 and the fulcrum 84 is less than the distance between the same pivot 81 and the pivots 61 which are fulcra for the support 40, a relative movement is produced between the hammer 91 and the drum 22 while the latter is being shifted towards the platen 10. The hammer 91 is thus displaced to the right and its head 95, pushing the inner part of the block 30 at the back, makes the selected bar 27 turn clockwise about the shoulder 37 of the flange 25 which acts as fulcrum, as as to make it protrude relative to the adjacent bars.

During displacement of the pivot bar 119 to the right, the pawl 126 jumps a tooth of the ratchet wheel 127 which is braked by the friction elements 131.

Movement of the support 40 to the right is resisted by the spring 74 which prevents too heavy an impact of the selected bar on the paper sheet. By screwing or unscrewing the nut 78 on the threaded portion of the rod 58 the force of this resisting action can be regulated in order to obtain an optimal impact.

The head 12, after printing the selected character on the paper sheet 11, returns to its rest position due to the action of the spring 100, rebound from the platen 10 and the action of the spring 74. The pawl 126, shifting to the left, then makes the wheel 127 rotate counterclockwise, overcoming the resistance of the friction elements 131. The latter, however, together with the wheel 127 act as dampers preventing rebound of the rocker 82 on to the bar 103 and settling the typing elements in a very short space of time.

The head 12 can easily be extracted from the printing device and, if desired, replaced by another.

Figure 2:
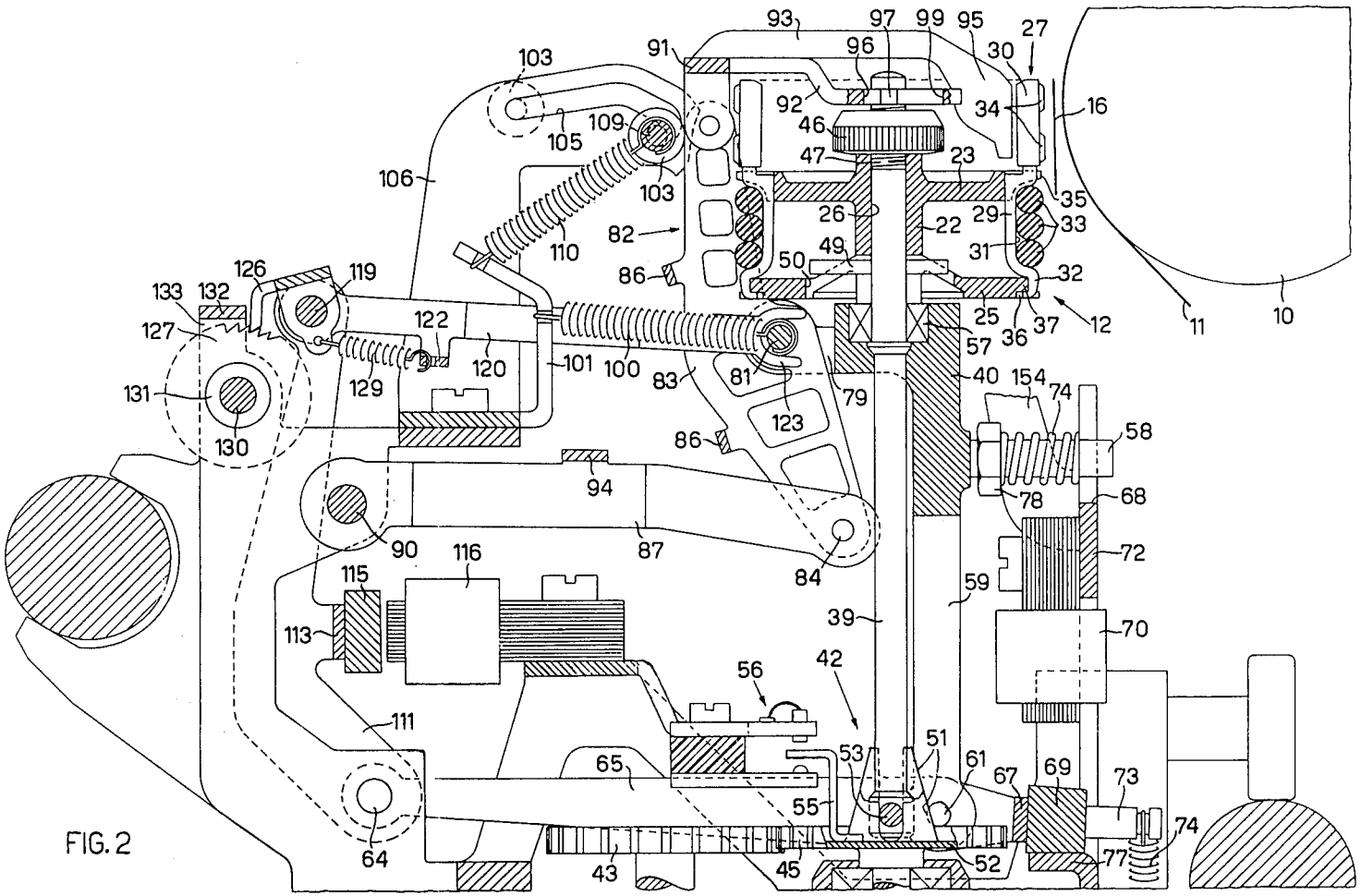
FIG. 2 is an enlarged detail of FIG. 1.

To do this the bar 103 is lifted out of the seats 91 against the pull of the spring 110 and slid along the slots 105 to the position shown in broken lines in FIG. 2. This position is stable because of the shape of the slots. The spring 100 now pulls the support 40 further to the left until the pawl 126 abuts the cross-piece 132. The rocker 82 therefore pivots anti-clockwise and withdraws the hammer until the enlargement 99 of the slot in the plate 92 is over the shaft 39. The hammer can now be swung up to allow the knob 46 to be unscrewed and the head 12 exchanged.

Alternatively, individual bars bearing the characters can be removed by hand from the head 12. In fact, by pushing inwards the block 30 of the bar 27 that is to be removed, the latter overcomes the elastic reaction of the rings 33, levers itself on the upper flange 23, and unhooks from the shoulder 37. Once unhooked it can be removed by a screwing movement from above and pulling it outwards from the head 12.

What we claim is:

1. A serial printing device comprising:

a platen;

a base member adjacent to said platen;

a type drum rotatably mounted on said base member;

a plurality of character-bearing elements;

mounting means for mounting said plurality of elements on the periphery of said drum for radially outward movement therefrom;

biasing means for biasing said character bearing elements against said drum;

angularly positioning means for rotating said drum on said base member to position a selected character-bearing element in front of said platen;

a hammer movably supported with respect to said drum to be spaced apart from the selected character-bearing element and actuatable for pushing said selected character-bearing element radially outwardly relative to said drum against the action of said biasing means;

actuatable means for moving said drum towards said platen; and means interconnecting said hammer with said drum for actuating said hammer in response to the actuation of the actuatable means to simultaneously actuate said drum and said hammer whereby the hammer pushes outwardly for printing only the selected character when the drum moves toward the platen.

2. A serial printing device according to claim 1, wherein said base member includes first and second pivot means; wherein said actuatable means comprises a support having one end portion pivotally mounted on said first pivot means and the other end portion rotatably connected to said drum; and wherein the interconnecting means comprises an actuating lever having one end portion pivotally mounted on said second pivot means, having the other end portion connected to said hammer and having an intermediate portion connected to said support.

3. A serial printing device according to claim 2, wherein the distance between said first pivot means and said intermediate portion is greater than the distance between said second pivot means and said intermediate portion.

4. A serial printing device according to claim 3, wherein said interconnecting means comprises an actuating strut and means mounting said actuating strut for simultaneously rotating said support about said first pivot means and said actuating lever about said second pivot means.

5. A serial printing device accordign to claim 4, wherein each of said character-bearing elements has embossed thereon two axially spaced characters defining two circumferential character tracks, and wherein said device further comprises selective shifting means for axially shifting said drum to selectively bring one of said two tracks in a printing position with respect to said platen.

6. A serial printing device according to claim 5, wherein said shifting means comprises a first support lever pivotally mounted on a first fixed pivot axis on said base member and having said first pivot means thereon and wherein said second pivot means comprises a second support lever pivotally mounted on a second fixed pivot axis on said base member and disposed substantially parallel to said first support lever.

7. A serial printing device according to claim 6, further comprising a shaft rotatably mounted on said support, and having means connecting said drum with said angularly positioning means comprising a sliding universal joint wherein said angularly positioning means is mounted on said base member and wherein said joint comprises a fork connected to said positioning means and a pin perpendicularly mounted on said shaft and lodged on said fork, said pin, said first pivot means and said first fixed pivot axis being substantially coplanar.

8. A serial printing device according to claim 6, wherein said strut is connected to said intermediate portion of said actuating lever and wherein said strut is substantially parallel to said first and second support levers.

9. A serial printing device according to claim 2, further comprising an electromagnet mounted on said base member, an armature cooperating with said electromagnet and connected to said support, and a return spring for biasing said armature in a rest position, a pawl connected to said armature, a frictionally restrained ratchet wheel mounted on said base member and cooperating with said pawl to damp the return movement of said armature under the action of said return spring.

10. A serial printing device comprising:

a platen;

a base member;

first and second pivot means mounted on said base member;

a support pivotally mounted on said first pivot means;

a type drum rotatably mounted on said support;

a plurality of character-bearing elements;

mounting means for removably mounting said plurality of elements on the periphery of said drum for radially outward movement therefrom;

biasing means for biasing said elements against said drum;

positioning means for rotating said drum on said support to position a selected character-bearing element in front of said platen;

actuating means for pivoting said support about said first pivot to move said drum towards said platen;

a hammer member movably supported with respect to the drum and spaced apart from the selected character bearing element and cooperative with said selected character-bearing element for moving same radially outward from said drum; and means for effecting said hammer to push said selected character-bearing element outwardly relative to said drum against the action of said biasing means when said drum moves toward said platen comprising a lever member having one end pivoted on said second pivot means, the other end connected to said member and an intermediate portion pivotably mounted on said support and wherein the distance between said first pivot means and said intermediate portions is greater than the distance between said second pivot means and said intermediate portion.

11. A serial printing device comprising:

a platen;

a base member;

a type head;

means mounting said type head on said base member for movement towards and away from the platen to define a printing position and a rest position respectively;

actuating means for moving said type head towards said platen from said rest position to said printing position;

biasing means for biasing said type head into said rest position; and means for damping the return movement of said type head from said printing position to said rest position under the influence of said biasing means, the damping means comprising a ratchet wheel mounted on said base member, friction means for frictionally restraining said ratchet wheel and a pawl connected to said type head and cooperative with said wheel during the return movement of said type head from said printing position to said rest position to absorb the kinetic energy of the type head developed in overcoming said friction means whereby rebounds of the type head in the rest position are prevented and the operative speed of the device may be increased.

12. A serial printing device according to claim 11 wherein said biasing means comprises a spring.

13. A serial printing device according to claim 11, wherein said ratchet wheel has a plurality of teeth around the periphery thereof and wherein said serial printing device further comprises spring means for preventing the engagement of said pawl with said ratchet teeth during the movement of said type head from said rest position to said printing position and for effecting engagement of pawl with said ratchet teeth frictional of said wheel during the return movement of said head from said printing position to said rest position thereby rotating said ratchet wheel against the force of the frictional clamping thereon.

14. A serial printing device comprising:

a platen;

a base member;

a type drum;

a shaft rotatably mounted on said base member and having one end portion connected to said drum, said one end portion including a threaded portion and a neck portion extending outwardly from said drum;

a plurality of character-bearing bars individually pivotally mounted vertically on the periphery of said drum and each including an upper portion upwardly projecting from said drum and on which characters are embossed;

a releasable locking member cooperative with said threaded portion of said shaft for releasably locking said drum to said shaft;

an actuatable hammer disposed near said upper portions of said bars and above said locking member and actuatable for cooperating with said upper portions of said character bearing bars to pivot said bars and to bring said embossed characters against said platen;

an actuating member for actuating said hammer and wherein said hammer has one end portion pivoted on said actuating member and the other end disposed near said upper portions of said bars, and an intermediate portion having a slot guided in said necked portion of said shaft and a hole larger than said neck portion; and means mounting the actuating member for movement from a rest position to an actuated position and from said rest position to an inoperative position and wherein said intermediate portion of said hammer is disengageable from said necked portion of said shaft through said hole when said actuating member is in said inoperative position to permit the unlocking of said locking member and the removal of said drum from said shaft.

15. In a serial printing device, a type head comprising:

type drum means comprising a pair of flanges spaced apart and overlapped parallel therebetween, said flanges having a plurality of peripheral radial recesses;

a plurality of character-bearing elements, each one of said character-bearing elements comprising a bar including a lower part having two extremities lodged in said recesses and an upper part protruding upwardly from said drum and on which at least one character is embossed; and means for removably mounting each of said elements on said type drum means comprising radial arrest means cooperating with said two extremities of said lower part of said elements for arresting the inner radial movement thereof, elastic ring means cooperating with the outer portion of said lower part between said two extremities thereof for biasing said character-bearing elements against said radial arrest means, and a hook in the lower of said two extremities of said lower part cooperating with the lower of said two flanges, said hook being disengageable from said lower flange upon urging said upper part inwardly to rotate said bar on the upper of said two flanges against the action of said elastic means to thereafter axially remove the character-bearing element from said drum means.

16. A type head according to claim 15, wherein said elastic ring means comprises a plurality of elastic rings and wherein each one of said lower parts of said bars has an outer recess disposed between said two extremities in which are located said plurality of elastic rings.

* * * * *